US010260742B2

(12) United States Patent
Buden

(10) Patent No.: US 10,260,742 B2
(45) Date of Patent: Apr. 16, 2019

(54) HEATING TORCH

(71) Applicant: FERNDALE INVESTMENTS PTY LTD, Victoria (AU)

(72) Inventor: Martin George Buden, Victoria (AU)

(73) Assignee: Ferndale Investments Pty Ltd, Victoria (AU)

( * ) Notice: Subject to any disclaimer, the term of this patent is extended or adjusted under 35 U.S.C. 154(b) by 185 days.

(21) Appl. No.: 14/410,259

(22) PCT Filed: Jun. 21, 2013

(86) PCT No.: PCT/AU2013/000667

§ 371 (c)(1),
(2) Date: Dec. 22, 2014

(87) PCT Pub. No.: WO2013/188923

PCT Pub. Date: Dec. 27, 2013

(65) Prior Publication Data

US 2015/0192293 A1 Jul. 9, 2015

(30) Foreign Application Priority Data

Jun. 22, 2012 (AU) ..... 2012902649

(51) Int. Cl.
*F23D 14/52* (2006.01)
*F23D 14/58* (2006.01)

(52) U.S. Cl.
CPC ..... *F23D 14/583* (2013.01); *F23D 14/52* (2013.01); *F23D 14/58* (2013.01)

(58) Field of Classification Search
None
See application file for complete search history.

(56) References Cited

U.S. PATENT DOCUMENTS 862,796 A * 8/1907 Blanchard ..... F23D 14/00 246/428
900,652 A * 10/1908 Blanchard ..... F23D 11/44 431/210

(Continued)

FOREIGN PATENT DOCUMENTS

EP 0374423 6/1990
GB 876064 8/1961

(Continued)

OTHER PUBLICATIONS

European Search Report dated Mar. 22, 2016 issued in counterpart application No. 13806885.3-1602, 8 pages.

*Primary Examiner* — Avinash A Savani
*Assistant Examiner* — Martha M Becton
(74) *Attorney, Agent, or Firm* — The Farrell Law Firm, P.C.

(57) ABSTRACT

A heating torch (10) for burning a mixture of fuel and air. The heating torch (10) includes a fuel inlet port (12) for supplying fuel from a fuel source to an air entrainment chamber (14). The air entrainment chamber (14) includes at least one air inlet (22) for supplying air from the atmosphere to the air entrainment chamber (14). The air entrainment chamber 14 includes an outlet (26) for discharging from the air entrainment chamber (14) a mixture of fuel and air in a flow path extending from the outlet (26). The heating torch (10) also includes a combustion chamber (28) provided in the flow path A and spaced from the outlet (26). The combustion chamber (28) has an open end (30) facing in a generally downstream direction away from the outlet (26). The combustion chamber (28) includes at least one side opening (36) extending along a side of the combustion chamber (28).

9 Claims, 1 Drawing Sheet

(56) References Cited

U.S. PATENT DOCUMENTS 1,698,555 A * 1/1929 Molz ..... F23D 1/00 110/262
1,925,183 A * 9/1933 Forster ..... F23D 14/08 431/349
2,604,937 A * 7/1952 Nagel ..... F23D 14/00 431/10
2,665,748 A * 1/1954 Cornelius ..... F23D 11/001 431/114
2,666,480 A * 1/1954 Peterson ..... F23D 14/28 431/142
2,720,080 A * 10/1955 Oulianoff et al. ..... F23R 3/60 60/751
2,811,832 A * 11/1957 Flanigen ..... F23R 3/10 60/756
3,078,915 A * 2/1963 Webster ..... F23D 14/52 431/353
3,211,207 A * 10/1965 Luft ..... F23D 11/406 239/402.5
3,229,680 A * 1/1966 Hebert ..... F23D 14/18 126/92 B
3,554,679 A * 1/1971 Brunner ..... F23D 14/38 126/401
3,574,508 A * 4/1971 Rothhaar ..... F23D 14/36 431/351
3,592,578 A * 7/1971 Weatherston ..... F23D 14/34 239/557
3,730,668 A * 5/1973 Iida ..... F23C 6/04 431/10
3,779,694 A * 12/1973 Zagoroff ..... B65B 53/06 431/158
3,816,061 A 6/1974 Guth
3,869,243 A * 3/1975 Creuz ..... F23D 14/60 126/285 R
3,881,863 A * 5/1975 Creuz ..... F24H 9/1881 432/222
3,917,442 A 11/1975 Zagoroff
4,067,686 A 1/1978 Karpisek
4,171,199 A * 10/1979 Henriques ..... F23D 11/406 239/424.5
4,313,721 A * 2/1982 Henriques ..... F23D 11/406 239/424.5
4,457,704 A * 7/1984 Sommers ..... F23D 14/64 431/238
4,496,310 A * 1/1985 Hannen ..... F23D 14/74 431/350
4,673,350 A * 6/1987 Collier ..... F23D 14/24 126/91 A
4,790,744 A * 12/1988 Bellet ..... F23L 15/04 431/242
RE33,136 E * 12/1989 Courrege ..... F23D 14/14 431/329
4,963,089 A * 10/1990 Spielman ..... F23D 14/22 431/278
5,049,066 A * 9/1991 Kaiya ..... F23D 14/00 431/187
5,055,032 A * 10/1991 Altemark ..... F23D 14/20 431/154
5,062,791 A * 11/1991 Liou ..... F23D 14/38 431/266
5,213,494 A * 5/1993 Jeppesen ..... F23D 14/38 126/271.2 A
5,241,949 A * 9/1993 Collier ..... F27D 99/0035 126/91 A
5,344,314 A * 9/1994 Zagoroff ..... F23D 14/36 34/96
5,400,525 A * 3/1995 Sheley ..... F26B 21/001 34/360
5,540,213 A * 7/1996 Shell ..... F23D 11/06 126/109
6,010,329 A * 1/2000 Zagoroff ..... B01F 5/0413 126/405
7,591,648 B2 * 9/2009 Mosiewicz ..... F23D 14/62 110/260
9,194,604 B2 * 11/2015 Bowsher ..... F24H 3/0488
9,453,642 B2 * 9/2016 Arnold, III ..... F23D 14/56
2009/0075223 A1 * 3/2009 Mosiewicz ..... F23D 14/62 431/351

FOREIGN PATENT DOCUMENTS

GB 886700 1/1962
GB 1594435 7/1981

* cited by examiner

HEATING TORCH

PRIORITY

This application is a National Phase Entry of PCT International Application No. PCT/AU2013/000667, which was filed on Jun. 21, 2013, and claims priority to Australian Patent Application No. 2012 902649, which was filed on Jun. 22, 2012, the content of each of which is incorporated herein by reference.

INTRODUCTION

The present invention relates to a heating torch. More particularly, the invention relates to an improved heating torch, and to an attachment that may be fitted or retro-fitted to a heating torch to provide improved performance of the heating torch.

BACKGROUND OF THE INVENTION

A heating torch is a tool or device that is used to heat up a substance quickly. Heating torches can be used in a wide variety of applications, including for heating up air, metal plastic, bitumen and other materials. Materials may be heated for a variety of reasons. Often a concentrated area of a material requires heating prior to molding, to harden, to soften or to solidify the material in question. An exemplary use of heating torches includes those used by jewelers for brazing when making or repairing jewellery. Another example includes the use of heating torches by road construction workers, who use heating torches for heating bitumen. Heating torches are also used in foundry work and other manufacturing applications.

Existing heating torches function generally adequately for their intended uses, although the applicant considers current heating torch designs to be deficient in a number of aspects. In this regard existing heating torches are relatively inefficient in burning fuel, which is usually in the form of a flammable gas. Part of this inefficiency is due to the existence of uncombusted fuel being expelled from existing torches into the atmosphere. Some of this fuel may be burnt in a relatively dispersed manner, which produces less usable heat at the at which it is desired to provide concentrated heat location and subsequently burnt in an elongated manner, rather than it being more precisely directed so as to be burnt at the intended heating zone. As can be appreciated, this can result in the use of significantly more fuel than necessary to heat the object in question. The burning temperature of the fuel is also undesirably lower, since the expelling fuel occupies a greater volume and so takes longer to combust. In an effort to address this problem, the use of some heating torches has included directing pressurized oxygen or air into a combustion chamber to facilitate a more concentrated combustion of fuel proximate the torch outlet. Such an arrangement does, however, undesirably increase the cost of equipment and the complexity of use of such equipment.

Another inherent problem noted in existing heating torches relates to 'blow out". In this regard, if the velocity of the fuel expelled from a heating torch is set too high then the fuel is unable to be lit. Similarly, if, during use, the flow rate of the fuel expelled from the torch is adjusted to too high a flow rate of fuel then the flame can become unstable and blow itself out. If this occurs then the torch must be re-lit.

Existing heating torches tend to produce a heating flame extending directly from the hand-held wand portion of the torch. As a result, the hand-held portion, particularly the tip thereof, has the potential to heat up and potentially burn the torch operator in the event that the operator inadvertently touches the heated portion.

It would therefore be desirable to provide a heating torch designed to burn fuel in a more efficient manner and with a potentially more concentrated heat when compared to existing heating torches.

It would also be desirable to provide a heating torch that is less likely to blow itself out when compared to existing heating torches.

It would be further desirable to provide a heating torch which is less likely to heat up and thereby create a burn hazard for the torch operator.

SUMMARY OF THE INVENTION

According to one broad aspect of the present invention, there is provided a heating torch for burning a mixture of fuel and air. The heating torch includes a fuel inlet port for supplying fuel from a fuel source to an air entrainment chamber. The air entrainment chamber includes at least one air inlet for supplying air from the atmosphere to the air entrainment chamber. The air entrainment chamber includes an outlet for discharging from the air entrainment chamber a mixture of fuel and air in a flow path extending from the outlet. The heating torch also includes a combustion chamber provided in the flow path and spaced from the outlet. The combustion chamber has an open end facing in a generally downstream direction away from the outlet. The combustion chamber includes at least one side opening extending along a side of the combustion chamber.

The provision of a combustion chamber downstream of the outlet has been determined by the applicant to provide considerable advantages when compared to existing heating torches, which are not provided with a combustion chamber. Advantages include a more controlled flame, which can be more accurately focused at a desired heating location, a more stable flame that is less likely to blow out, and more efficient burning of fuel, resulting in a more cost effective heating process. These advantages will be discussed later.

In one particularly preferred form, the combustion chamber includes a plurality of side openings spaced about the combustion chamber. That said, a single side opening may be provided in an annular or helical manner about the combustion chamber, which may provide similar benefits to an arrangement having a plurality of separate side openings.

In one envisaged form, each side opening may be generally slot-shaped. However, other opening shapes may also be provided. It is also envisaged that each slot may extend along the side of the combustion chamber in a direction generally towards the open end.

The combustion chamber preferably also has a closed end facing in a generally upstream direction towards the outlet. In such an arrangement, the side may extend between the closed end and the open end.

In one preferred form, the combustion chamber has a generally conical shape, with the closed end provided at an apex of the generally conically shaped combustion chamber.

It may be advantageous to provide a shroud extending at least partially about the combustion chamber and flow path. If a shroud is provided then it may be removably mounted to the combustion chamber or other suitable mounting point on the torch.

A secondary air inlet may be provided for, in use, the ingress of additional air into the mixture of fuel and air flowing along the flow path. The secondary air inlet may adopt any suitable form.

Preferably, a combustion chamber mount is provided for mounting the combustion chamber to the heating torch. The mount may be in the form of either a permanent mount or a releasable mount. The mount may mount the heating torch to the shroud, or may mount it to some other suitable portion of the torch.

So far, the invention has been generally described in the context of a heating torch including a combustion chamber. It is to be appreciated however, that a combustion chamber may also be provided that can be fitted or retro-fitted to existing heating torches. Thus, the invention is directed to a heating torch having a combustion chamber, as well as to a combustion chamber, per se, for fitting or retro-fitting to a heating torch.

In this regard, and in accordance with another broad aspect of the present invention, there is provided a combustion chamber for a heating torch for burning a mixture of fuel and air. The heating torch is of the type including a fuel inlet port for supplying fuel from a fuel source to an air entrainment chamber. The air entrainment chamber is of the types that includes at least one air inlet for supplying air from the atmosphere to the air entrainment chamber. The air entrainment chamber also includes an outlet for discharging a mixture of fuel and air from the air entrainment chamber in a flow path extending from the outlet. The combustion chamber has an open end for facing in a downstream direction away from the outlet; and the combustion chamber includes at least one side opening extending along a side of the combustion chamber.

BRIEF DESCRIPTION OF THE DRAWINGS

It will be convenient to hereinafter describe a preferred embodiment of the invention with reference to the accompanying figures. The particularity of the figures is to be understood as not limiting the preceding broad description of the invention.

FIG. 2 is shown in a slightly smaller scale compared to FIG. 1.

DETAILED DESCRIPTION OF THE DRAWINGS

Figure 1:
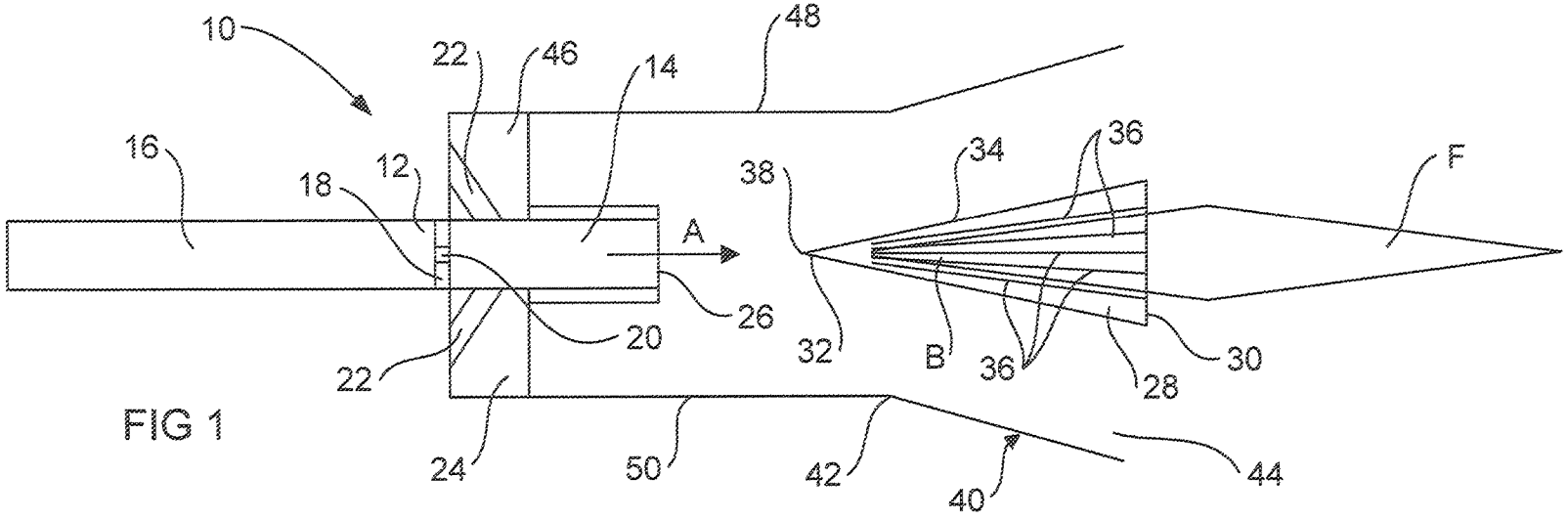
FIG. 1 is a diagrammatic sectional side view of a heating torch according to one non-limiting embodiment of the invention.

Referring to the Figures, there is provided a heating torch 10. The heating torch 10 is configured for burning a mixture of fuel and air. The torch 10 may be used with any suitable fuel. It is envisaged that the torch 10 could be used with a fuel supplied in a gaseous form, such as propane, natural gas, liquid petroleum gas or acetylene. However, it is to be appreciated that any suitable fuel supplied in liquid or gaseous form may be used with the torch 10.

Indeed, the torch 10 could be re-configured for burning a mixture of fuel and oxygen (rather than fuel and air), if desired.

The heating torch 10 includes a fuel inlet port 12 provided in the end of a hand-held wand portion 16 for supplying fuel from a fuel source to an air entrainment chamber 14. The air entrainment chamber 14 is mounted to the end of the wand portion 16. The illustrated chamber 14 is manufactured from a suitable grade of stainless steel, although any other suitable material may be used for its manufacture.

The fuel would typically be provided under a high pressure from a gas bottle or other suitable source (not shown), through a high pressure fuel line (not shown), then through a flow path provided in a hand-held wand portion 16, and into the chamber 14. The fuel is accelerated on exiting the end 18 of the wand 16 by passing through an exit orifice 20 of reduced cross-sectional diameter with compared to the cross-sectional diameter of the flow path provided in the wand 16. Thus, the fuel exits the orifice 20 and enters the air entrainment chamber 14 at a high flow rate.

A shut-off/regulator valve (not shown) is provided upstream of the exit orifice 20 for controlling the flow of fuel from the exit orifice 20.

The illustrated air entrainment chamber 14 includes six air inlets 22 equidistantly spaced about the base 24 of the chamber 14. Only two of the six inlets 22 can be seen in FIG. 1.

In use, the high flow rate of fuel flowing from the exit orifice 20 into the chamber 14 causes the entrainment of atmospheric air into the chamber 14 through the inlets 22, whereupon the fuel and air at least partially mix together.

The air entrainment chamber 14 includes an outlet 26 for discharging a mixture of fuel and air at high speed from the chamber 14. The mixture of fuel and air exits the chamber 14 in a generally linear flow path A (shown in FIG. 1).

A generally conically-shaped combustion chamber 28 is provided in the flow path A. It can be seen that the combustion chamber 28 is spaced from the outlet 26 along the flow path A.

The combustion chamber 28 has an open end 30 facing in a generally downstream direction away from the outlet 26, and a closed end 32 facing in a generally upstream direction towards the outlet 26. The chamber 28 also includes a side defined by a side wall 34. The side wall 34 extends between the open end 30 and the closed end 32.

The provision of the combustion chamber 28 is particularly advantageous. It has been found that the fuel within the fuel/air mixture burns with a flame pattern F of the type very generally shown in FIG. 2. This is a far more controlled flame pattern than found with existing heating torches. Also, the flame F is not as elongate, and so is far more compact when compared to that of existing torches. In turn, this means that the heat of the flame F is more concentrated and so advantageously potentially provides a higher heating temperature at the desired heating location. It also means that the fuel is burnt far more efficiently, such that less fuel is consumed for a given heating task when compared to existing heating torches.

The provision of the combustion chamber 28 advantageously also provides a more stable flame F that is less likely to inadvertently blow out, which can be inconvenient. The flame F is also less likely to be affected if used in high winds, because the base B of the flame is located within and protected by the combustion chamber 28.

The combustion chamber 28 is provided with a series of equidistantly spaced openings in the form of slots 36, which are provided in the side wall 34. The slots 36 extend along the side wall 34 of the combustion chamber 28 from slightly to the right (in the orientation shown in FIG. 1) of the apex 38 of the closed end 32 to the open end 30.

The slots 36 have been found to significantly improve the mixing of the fuel and air mixture prior to burning which, in turn, produces a significantly more consistent flame and more compact flame. The number, shape, size and location of the slots may vary to suit a specific application. Further, it may be that other opening shapes may be adopted in conjunction with or instead of slots.

The combustion chamber 28 illustrated is manufactured from a suitable grade of stainless steel, although other suitable materials may be used in the manufacture thereof.

The heating torch 10 also includes a generally frusto-conically shaped shroud 40. The ends 42, 44 of the shroud 40 are open. The shroud 40 extends about the combustion chamber 28. It is noted in the illustrated embodiment that the open end 30 of the combustion chamber 28 extends beyond the shroud 40 in the downstream direction, although this need not be so. Also the end 42 of the shroud 40 extends in an upstream direction beyond the apex 38 of the combustion chamber 28. The specific size, shape and location of the shroud 40 relative to the combustion chamber 28 may be selected as desired.

The shroud 40 provides protection to the torch operator and anyone in the vicinity from inadvertently touching the outer surface of the combustion chamber 28. In this regard, it is to be appreciated that the surface of the combustion chamber 28, during use, would be very hot and likely to burn anyone inadvertently coming into contact with it; whereas the surface shroud 40 is unlikely to be sufficiently hot to burn anyone. The shroud 40 also provides some protection for the flame and reduces the incidence of flame shape deformation that may occur when using the torch 10 in windy conditions.

The shroud 40 is mounted to an annular collar 46 of the air entrainment chamber 14 by way of connecting arms 48, 50 and 52 extending there between. It is to be appreciated that the precise arrangement for mounting the shroud 40 to the torch 10 may be selected as desired, and may differ from the arrangement illustrated in the figures. The shroud 40 is manufactured from a suitable grade of stainless steel, although any other suitable material may be used in the construction thereof.

The shroud 40 and combustion chamber 28 may be releasably mounted to the torch 10. This potentially allows for retro-fitting of the shroud 40 and combustion chamber 28 to existing heating torches. Indeed, it may be possible to retro-fit the shroud 40 and combustion chamber 28 as one unit; or to separately retro-fit one of the shroud 40 and combustion chamber 28, if desired. Any suitable mounting arrangement may be provided to facilitate the retro-fit.

In one envisaged form, the shroud 40 is removable. With the shroud 40 removed, the flame F extending from the torch 10 may be directed into hard to reach locations that would not be accessible with the shroud 40 mounted to the torch 10. The shroud 40 may be releasably mounted to the torch 10 so that it can be removed and re-fitted as required.

It has been found that the torch 10 will work with the shroud 40 removed without the flame F blowing itself out.

One envisaged application of the torch 10 with the shroud 40 removed includes heating steel (or other material) by placing the open end 30 of the combustion chamber 28 against the steel, such that the flame F engulfs the steel. Even with the combustion chamber 28 placed against the steel, the combustion chamber 28 still receives the necessary flow of fuel/air mixture by virtue of the slots 36 provided in the chamber 28.

The space 54 defined between the collar 44 and the end 42 of the shroud 40 defines a secondary air inlet 56. The secondary air inlet 56 provides for the ingress of additional air into the mixture of fuel and air flowing along the flow path A, and potentially improves the combustion of the fuel and air mixture within the combustion chamber 28. The secondary air inlet may adopt any other suitable form from that illustrated.

Figure 2:
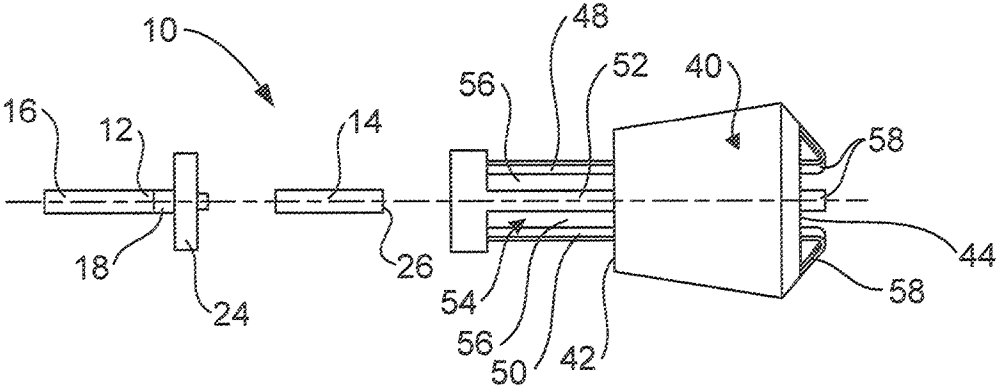
FIG. 2 is a side photographic exploded view of a heating torch substantially the same as that shown in FIG. 1. Any minor difference between the features shown in the Figures will be discussed hereinafter.

In the illustrated embodiment, the combustion chamber 28 is mounted in the position shown by virtue of eight spaced connecting arms 58 (only some of which are visible) extending between the open end 30 of the side wall 34 and the end 44 of the shroud 40. The connecting arms 58 are shown in FIG. 2, but have been omitted from FIG. 1 for clarity purposes. The connecting arms 56 are manufactured from a suitable grade of stainless steel. The combustion chamber 28, shroud 40, and connecting arms 48, 50, 52 and 58 of the illustrated embodiment are integrally formed.

The heating torch 10 has been generally described in the context of burning a mixture of fuel and air. However, the torch may be adapted for burning a mixture of fuel and oxygen. It is to be appreciated that the combustion chamber 28 and shroud 40 may be used irrespective of whether the torch 10 burns a mixture of fuel and air or fuel and oxygen.

The invention has been described in the context of a heating torch. However, the invention may also be adapted for use in other torch applications including, for example, cutting torch and/or welding torch applications.

The heating torch and combustion chamber of the present invention have been found to provide several noted advantages. These include the ability burn fuel in a more efficient manner when compared to existing heating torches, and with a more compact flame, thereby potentially providing a more focused and useable heat.

Another noted advantage is that present invention provides an arrangement whereby the heating torch flame is more stable and less likely to blow itself out when compared to existing heating torches.

It also advantageously reduces the likelihood of the torch operator or someone nearby being burnt or otherwise injured, given the more compact flame provided by the torch or the present invention, and also given that the flame is partially surrounded by a shroud.

The invention may also be easily adapted to provide an alternative and potentially improved cooker, wok burner, heater, oven burner, kiln burner, heating torch for liquid or gas combustion fuel, heating torch for roads/castings/pipelines, anti-wind blowout functional torch, or weed burner to those currently in use.

Finally, it is to be understood that various alterations, modifications and/or additions may be introduced into the construction and arrangement of the parts previously described without departing from the spirit or ambit of this invention.

The invention claimed is:

1. A heating torch for burning a mixture of fuel and air, the heating torch comprising:

a fuel inlet port for supplying fuel from a fuel source to an air entrainment chamber;

the air entrainment chamber comprising at least one air inlet for supplying air from the atmosphere to the air entrainment chamber;

the air entrainment chamber comprising an outlet for discharging from the air entrainment chamber a mixture of fuel and air in a flow path extending from the outlet;

a combustion chamber provided in the flow path and separated from the outlet;

the combustion chamber comprising:

an open end facing in a generally downstream direction away from the outlet, a closed end facing in a generally upstream direction towards the outlet, and at least one side opening extending along a side of the combustion chamber from the closed end towards the open end;

a shroud extending at least partially about the combustion chamber and the flow path;

a secondary air inlet for ingress of additional air into the mixture of fuel and air flowing along the flow path; and a plurality of connecting arms, with each connecting arm of the plurality of connecting arms extending between the open end and an end of the shroud, wherein a flame produced by combustion of the fuel and air mixture extends from a flame base located within the combustion chamber.

2. The heating torch according to claim 1, wherein the combustion chamber comprises a plurality of side openings spaced about the combustion chamber.

3. The heating torch according to claim 1, wherein the at least one side opening is generally in the shape of a slot.

4. The heating torch according to claim 3, wherein the slot shaped at least one side opening extends along the at least one respective side of the combustion chamber in a longitudinal direction generally from the closed end towards the open end.

5. The heating torch according to claim 1, wherein the combustion chamber has a generally conical shape.

6. The heating torch according to claim 5, wherein the closed end is provided at an apex of the generally conically shaped combustion chamber.

7. The heating torch according to claim 1, wherein the ingress of additional air into the mixture of fuel and air is within the combustion chamber.

8. The heating torch according to claim 1, further comprising a releasable shroud mount for releasably mounting the shroud to the heating torch.

9. The heating torch according to claim 1, further comprising a combustion chamber mount for mounting the combustion chamber to the heating torch.

* * * * *